US006258168B1

(12) United States Patent
Pawelko et al.

(10) Patent No.: US 6,258,168 B1
(45) Date of Patent: Jul. 10, 2001

(54) APPARATUS FOR APPLYING ADHESIVE TO A WEB-SHAPED CARRIER

(75) Inventors: Karl-Heinz Pawelko, Marschacht; Franz Rottmann, Glinde, both of (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/374,700

(22) Filed: Aug. 6, 1999

(30) Foreign Application Priority Data

Aug. 6, 1998 (DE) ..... 198 35 532

(51) Int. Cl.[7] ..... B05C 1/08

(52) U.S. Cl. ..... 118/688; 118/690; 118/694; 118/667; 118/708; 118/712; 118/244; 118/259; 118/262

(58) Field of Search ..... 118/667, 688–691, 118/693, 694, 708, 712, 244, 259, 262; 427/8, 207.1, 428; 131/908, 284, 35, 69, 90; 156/356, 578

(56) References Cited

U.S. PATENT DOCUMENTS 3,974,007 8/1976 Greve .
4,449,476 * 5/1984 Voswinckel et al. ..... 118/694
4,721,119 1/1988 Ludszeweit et al. .
4,901,860 2/1990 Wahle et al. .
5,101,762 * 4/1992 Nakade ..... 118/667
5,330,576 * 7/1994 Clauditz ..... 118/688

* cited by examiner

*Primary Examiner*—Laura Edwards
(74) *Attorney, Agent, or Firm*—Venable; Robert Kinberg

(57) ABSTRACT

A paster for the application of a film of water-containing adhesive to a running substrate of cigarette paper or the like automatically replaces the evaporated percentage of water when the substrate-processing machine is idle but the paster continues to circulate adhesive in order to prevent a rise in the viscosity of the then circulating and water releasing adhesive. The quantity of water in the circulating adhesive and other parameters (such as the temperature) of the adhesive are monitored by several sensors, and signals which are transmitted by such sensors are processed to regulate the admission of water in order to maintain the percentage of water, and hence the consistency, of the circulating adhesive within a range not appreciably departing from that when the paster is in actual use to apply one or more films of adhesive to the running substrate.

16 Claims, 1 Drawing Sheet

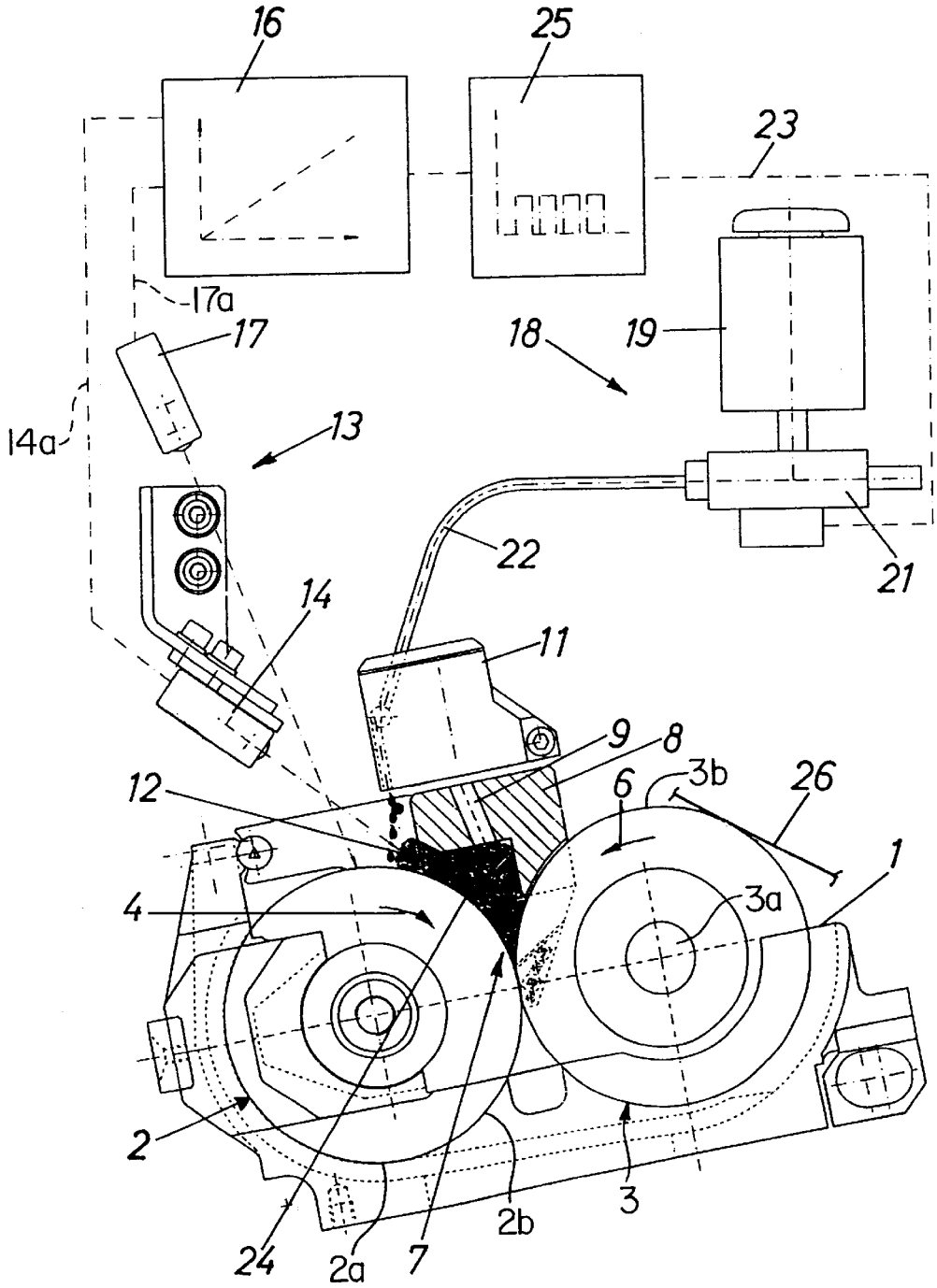
16
25
23
17a
17
18
19
14a
13
22
21
14
11
9
8
12
6
3b
26
1
4
3a
2
3
2b
24
2a
7

APPARATUS FOR APPLYING ADHESIVE TO A WEB-SHAPED CARRIER

BACKGROUND OF THE INVENTION

This invention relates to improvements in apparatus for and in methods of applying adhesive to web- or strip-shaped carriers, and more particularly to improvements in so-called pasters which can be utilized to apply one or more films of a suitable adhesive (such as hotmelt) to one side of a running substrate. Apparatus or pasters of such character can be utilized in filter or cigarette rod making and analogous machines to apply a film or coat of a suitable adhesive to one side (or to one marginal portion of one side) of a running web of cigarette paper, imitation cork or the like, or to a series of successive blanks (portions of a previously continuous web or strip) which can be converted into uniting bands in filter tipping machines, into tubular wrappers of continuous cigarette or filter rods, into discrete blanks for conversion into packets for cigarettes of the like, or for analogous purposes.

It is known to form an adhesive-coated strip- or web-shaped carrier from cigarette paper or the like by providing one side or one or more selected portions of one side of the carrier with one or more narrow strips or with a full coat or film of adhesive paste. The fully coated strip can be converted into discrete uniting bands which are utilized in a so-called tipping or filter tipping machine to connect filter rod sections of double unit legth with pairs of plain cigarettes of unit length. The thus obtained filter cigarettes of double unit length are thereupon halved to yield pairs of filter cigarettes of unit length.

It is also known to drape a continuous rod-like filler consisting of tobacco particles into a continuous cigarette paper web in such a way that one marginal portion of the resulting tubular envelope overlies and adheres to the other marginal portion. The application of adhesive to one marginal portion is carried out in or ahead of a so-called garniture wherein successive increments of the running web of wrapping material are caused to surround successive increments of the rod-shaped tobacco filler. The making of filter rod sections of unit length or multiple unit length is analogous; the main difference is that the material to be wrapped is a continuus rod (namely a converted tow) of filamentary filter material for tobacco smoke.

Filter tipping machines which employ webs or strips of so-called tipping paper, means for coating one side of the web with a film of adhesive, means for subdividing the adhesive-coated web into discrete uniting bands and for draping uniting bands around discrete filter rod sections and pairs of plain cigarettes are disclosed, for example, in commonly owned U.S. Pat. No. 4,901,860 granted Feb. 20, 1990 to Günter Wahle et al. for "APPARATUS FOR TESTING AND CLASSIFYING CIGARETTES OR THE LIKE". Apparatus for converting a tow of filter material for tobacco smoke into filter rod sections or filter mouthpieces of desired length are disclosed, for example, in U.S. Pat. No. 3,974,007 granted Aug. 10, 1976 to Heinz Greve for "METHOD AND APPARATUS FOR THE PRODUCTION OF FILTER ROD SECTIONS OR THE LIKE". A cigarette making machine wherein one marginal portion at one side of a continuous running web of cigarette paper can be coated with adhesive upstream of a garniture is disclosed, for example, in commonly owned U.S. Pat. No. 4,721,119 granted Jan. 26, 1988 to Dieter Ludszeweit et al. for "ROD MAKING MACHINE WITH MEANS FOR ADJUSTING THE POSITION OF WRAPPING MATERIAL".

The viscosity of the film or films of adhesive paste remain at least substantially unchanged if the paster is operated continuously. However, the situation is different if the operation of the machine which processes adhesive-coated strips of cigarette paper, tipping paper or the like is arrested or slowed down because this entails substantial changes in the condition (particularly viscosity) of the adhesive in the paster. Thus, the volatile constituent(s) or ingredient(s) of the adhesive (a customary volatile ingredient is water) is or are likely to evaporate while (as is customary) the adhesive is caused to circulate during temporary stoppage of the processing machine or machines (such as the above enumerated filter rod making, filter tipping and cigarette rod making machine(s)). Continuous circulation or agitation of the adhesive is advisable because a mass of stagnant adhesive is likely to harden or to increase its viscosity to an extent which prevents adequate coating of a running web in response to renewed activation of the processing machine (s). However, even such continuous circulation does not prevent undesirable changes in viscosity of the adhesive paste because the volatile ingredient(s) of the adhesive is or are normally bound to escape at a rate which is sufficiently high to adversely influence the characteristics of the adhesive and necessitates segregation of long series of filter cigarettes when the processing machine(s) is or are restarted or accelerated from less than full speed to normal operating speed.

In the absence of any undertakings to the contrary, even short-lasting or extremely short-lasting accelerations of a filter tipping, cigarette rod making or other machine while the adhesive is less than fully satisfactory invariably results in the making of long series of defective plain cigarettes, filter cigarettes or analogous products because a modern high-speed machine of such character can turn out up to and even in excess of 15,000 rod-shaped articles per minute.

OBJECTS OF THE INVENTION

An object of the invention is to provide a novel and improved apparatus which can be utilized for the application of adhesive containing one or more volatile ingredients and which is constructed, assembled and operated in such a way that short- or long-lasting interruptions in the delivery of adhesive to one or more substrates do not adversely affect the quality of the adhesive and/or of the products containing such adhesive.

Another object of the invention is to provide a novel and improved method of preventing changes in the quality (particularly viscosity) of adhesive which is being applied to one or more running substrates (e.g., running webs or strips of cigarette paper or tipping paper) under circumstances which necessitate repeated interruptions or other changes (such as decelerations) of the rate of dispensing adhesive from the magazine of a paster or the like.

A further object of the invention is to provide a novel and improved method of and a novel and improved arrangement for maintaining the percentage of volatile constituent(s) of adhesive at an optimum value under circumstances which, at the present time, necessarily entail pronounced chages of the percentage of such constituents and hence of the the viscosity of the adhesive.

An additional object of the invention is to provide a novel and improved paster for use in filter tipping and/or other machines of the tobacco processing industry.

Still another object of the invention is to provide an adhesive applying apparatus which is capable of maintaining the quality of adhesive at a constant (optimal or nearly optimal) value irrespective of the duration and/or frequency of interruptions of delivery of adhesive from a source to a running web or strip or another substrate for one or more films of adhesive.

A further object of the invention is to provide a paster which can be put to use in lieu of heretofore known pasters in order to achieve pronounced savings in adhesive and a substantial reduction of the number of rejects (such as plain or filter cigarettes and the like) which employ web- or strip-shaped substrates with one or more films of adhesive of pasty or other desired consistency.

Another object of the invention is to provide a novel and improved production line which can be utilized for the making of rod-shaped smokers' products and employs one or more pasters of the above outlined character.

An additional object of the invention is to provide a novel and improved method of achieving substantial savings in adhesive paste and a pronounced reduction of the number of rejects in a machine which assembles or produces commodities containing webs or strips or other substrates carrying one or more films of adhesive containing one or more volatile constituents or ingredients.

A further object of the invention is to provide novel and improved combinations of signal generating and processing units for use in the above outlined apparatus.

SUMMARY OF THE INVENTION

One feature of the invention resides in the provision of an apparatus which can be put to use as a means for applying to a running substrate (such as a web of cigarette paper, artificial cork or the like) at least one film of an adhesive normally containing a preselected percentage of an evaporable constituent. For example, the adhesive can contain a preselected percentage of water. The improved apparatus comprises a vessel for a supply of adhesive, means for supplying to the vessel a flow of adhesive, a rotary applicator having a surface which dips into the supply to continuously draw a film of adhesive from the vessel, to apply the withdrawn film to the running substrate outside of the vessel and to thereupon reenter the vessel and restore the film, means for limiting the quantity of adhesive leaving the vessel with the surface of the applicator, signal generating means for monitoring the supply of adhesive in the vessel to ascertain the actual percentage of evaporable constituent, a source of evaporable constituent, and means for admitting evaporable constituent from the source to the adhesive (in or at the vessel) in response to signals which denote that the actual percentage of evaporable constituent in the adhesive is below the preselected percentage.

The applicator can comprise a first roller and means (such as a shaft) for driving the first roller in a first direction. The means for limiting the quantity of adhesive leaving the vessel can comprise a second roller and means for rotating the second roller in a second direction counter to the first direction. The two rollers define a nip for a portion of the supply of adhesive in the vessel and the supply of adhesive is preferably caused to exhibit a bulge which is monitored by the signal generating means.

The signal generating means can comprise means for monitoring the quantity of adhesive in the vessel. In accordance with a presently preferred embodiment, the vessel has at least one overflow opening for adhesive and the signal generating means comprises means for monitoring the quantity of adhesive overflowing through the at least one opening.

The means for supplying adhesive can comprise at least one conduit which serves to supply a continuous flow of adhesive from a source of adhesive into the vessel. The means for monitoring the quantity of adhesive overflowing through the at least one opening of the vessel can comprise at least one sensor which is installed at a predetermined distance from the at least one overflow opening.

The just mentioned sensor can be designed and installed in such a way that changes in the distance from the sensor to the supply of adhesive in the vessel are indicative of the quantity of adhesive in the vessel.

The means for admitting evaporable constituent in response to the aforediscussed signals can comprise at least one outlet which discharges the evaporable constituent in the region of the at least one overflow opening. For example, the outlet can be oriented to direct evaporable constituent against the means for limiting the quantity of adhesive leaving the vessel with the surface of the rotary applicator. The admitting means can comprise a receptacle for evaporable constituent and a suitable pump which serves to deliver evaporable constituent from the receptacle to the at least one outlet in response to signals indicating that the admission of evaporable constituent into the supply of adhesive being circulated in the improved apparatus is warranted. The at least one outlet can be provided in a distributor which is adjacent the vessel for the supply of adhesive.

The signal generating means can include means for monitoring the temperature of the applicator and/or of the limiting means, and means for generating first signals denoting the monitored temperature. Such signal generating means can further comprise means for monitoring the quantity of adhesive in the vessel and for generating second signals denoting the monitored quantity of adhesive. Still further, the signal generating means can comprise means for processing the first and second signals and means for transmitting processed signals to the source of evaporable constituent. In accordance with a presently preferred embodiment, the processing means can comprise means for transmitting processed signals which denote a relationship between the monitored temperature and changes of the percentage of evaporable constituent in the monitored quantity of adhesive.

Another feature of the invention resides in the provision of a method which can be practiced by resorting to the aforedescribed improved apparatus.

The novel features which are considered as characteristic of the invention are set forth in particular in the appended claims. The improved apparatus itself, however, both as to its construction and its mode of operation, together with numerous additional important and advantageous features and attributes thereof, will be best understood upon perusal of the following detailed description of certain presently preferred specific embodiments with reference to the accompanying drawing.

BRIEF DESCRIPTION OF THE DRAWING

The single FIGURE of the drawing is a partly diagrammatic in part elevational and in part sectional view of an apparatus which can be utilized in a production line for the making of plain or filter cigarettes, filter rods or other rod-shaped products of the tobacco processing industry and wherein the quality of adhesive is maintained at or at least close to an optimum value in accordance with one embodiment of the method of the present invention.

DESCRIPTION OF PREFERRED EMBODIMENTS

The drawing shows a portion of an apparatus, also called paster, which can be utilized for the making of smokers' products, particularly rod-shaped smokers' products. However, the improved apparatus can be utilized with equal or similar advantage for the making of products bearing no relationship to the tobacco processing industry, for example, catamenial tampons, batteries, wrapped straws and/or others.

It is assumed that the apparatus which is shown in the drawing is to be utilized in lieu of the paster 68 shown in FIG. 4 of the aforementioned U.S. Pat. No. 4,901,860 to G ünter Wahle et al., i.e., to coat one side of a running web 26 of tipping paper with an adhesive prior to subdivision of the web into a series of discrete uniting bands to be utilized in a filter tipping machine in a manner as fully described in the '860 patent to Wahle et al.

The apparatus comprises a container 1 for two parallel rollers 2, 3 driven by the respective shafts 2*a*, 3*a* to rotate in opposite directions (note the arrows 4, 6). The roller 3 serves as a rotary applicator which delivers a film of adhesive to one side of the running web (substrate) 26, i.e., a web of cigarette paper, artificial cork or other suitable tipping paper. The roller 2 serves as a means for limiting the quantity of adhesive leaving a vessel 8 with the peripheral surface 3*b* of the applicator roller 3. The container 1 serves to collect adhesive which escapes or might escape from the vessel 8 in a downward direction. The vessel 8 is located above the nip 7 of the rollers 2, 3 and receives adhesive of desired (optimum) consistency from a source including a conduit 9 serving as a means for supplying adhesive into the nip 7, i.e., into the vessel 8.

The vessel 8 carries a distributor 11 and is provided with a lateral overflow opening 12 for a bulge of adhesive 24 which fills the nip 7 and the interior of the vessel 8. The extent to which the bulge projects beyond the overflow opening 12 is indicative of the quantity of the body of adhesive 24. The adhesive contains at least one evaporable constituent (e.g., water and hereinafter referred to as water) as well as one or more other ingredienta (well known) which are necessary to ensure satisfactory transfer of the adhesive film from the surface 3*b* of the applicator roller 3 to the underside of the running substrate.

The apparatus further comprises a signal generating system 13 including a level indicator 14 which serves to monitor the supply of adhesive 24 in the vessel 8 to ascertain the actual percentage of water (evaporable constituent in and above the nip 7. The level indicator 13 includes a sensor 14 which is installed at a fixed distance from the overflow opening 12 and emits a beam of suitable radiation. Such radiation is reflected by the bulge of adhesive 24 at the overflow opening 12, and the intensity and/or another characteristic of the reflected beam is indicative of the quantity of adhesive in and above the nip 7. The signal 14*a* which issues from the sensor 14 is transmitted to one input of a signal processing circuit 16. The latter has a second input for a signal 17*a* issuing from a temperature sensor 17 which, in the illustrated embodiment, indirectly monitors the temperature of adhesive 24 by monitoring the temperature of the quantity limiting roller 2 at a location preferably immediately or closely adjacent the overflow opening 12.

In accordance with a feature of the invention, the apparatus further comprises a water admitting aggregate 18 including a source 19 (e.g., a water tank) and a pump 21 which is receptive to output signals transmitted by a conductor or detector 23. This causes the pump 21 to admit water into an outlet 22 discharging onto the peripheral surface 2*b* of the roller 2 adjacent the overflow opening 12 of the vessel 8. The rate at which the pump 21 delivers water via outlet 22 of the aggregate 18 is a function of the characteristics of the signals transmitted to the signal processing unit 16 at 14*a* and 17*a*. The signal which is transmitted by the unit 16 is compared with a reference signal furnished by a signal comparing stage 25, and the latter transmits to the pump 21 (via conductor means 23) signals denoting those quantities of water which are to be supplied via outlet 22 in order to ensure that the percentage of water in the body 24 of adhesive will match or at least closely approximate an optimum value. The outlet 22 delivers water to the distributor 11 which ensures that the water entering the vessel 8 is uniformly distributed in the body of adhesive in the vessel 8.

The operation of the improved apparatus is as follows:

When the substrate 26 is advanced at a customary (prescribed) speed, the chamber 8 receives adhesive by way of the supplying means including the inlet 9 because the monitoring means 13 including the sensors 14 and 17, the signal processing unit 16 and the signal comparing stage 25 indicate that the percentage of water in the body 24 of adhesive is satisfactory. In other words, the pump 21 is idle and the outlet 22 does not supply water to the peripheral surface 2*b* of the roller 2.

That portion of the adhesive film on the surface 3*b* of the supplying roller 3 which is not accepted by successive increments of the running substrate 26 is delivered to the container 1 or into the nip 7, i.e., into the vessel 8.

The aggregate 18 can become active to initiate the admission of water from the source 19 into the outlet 22 if the sensors 14 and 17 transmit (at 14*a*, 17*a*) signals denoting that the percentage of water in the body 24 of adhesive in the vessel 8 is unsatisfactory.

If the machine which processes the substrate 26 is arrested or slowed down for any one of several potential reasons (e.g., due to malfunction), the shafts 2*a*, 3*a* continue to rotate the respective rollers 2, 3 so that the adhesive forming the body 24 continues to circulate from the vessel 8, with the surfaces 2*b*, 3*b* and back to the nip 7. This invariably entails a reduction in the volume of the body 24 because water is bound to evaporate from the adhesive which is being conveyed by the surfaces 2*b*, 3*b* out of the vessel 8 and back into the nip 7. Such drop in the quantity of adhesive is detected by the sensor 14 which monitors the size of the bulge of adhesive paste at the overflow opening 12.

In the absence of a remedial undertaking, the viscosity of the adhesive in the vessel 8 would increase beyond an acceptable value, i.e. the adhesive which would be transferred (if transferred at all) onto the substrate 26 upon restarting of the machine serving to process the substrate would be unsatisfactory and the corresponding products (such as filter cigarettes) would be discarded upon detection by the product monitoring system or systems of the filter tipping machine.

Signals which are transmitted (at 14*a*) from the sensor 14 to the signal processing unit 16 are processed to ascertain reductions of the quantity of adhesive in the vessel 8 due to temporary stoppage of the filter tipping machine and/or for any other reasons (e.g., due to leakage). The unit 16 processes the signals from the sensor 14 with those from the sensor 17 and transmits to the signal comparing stage 25 signals which are indicative of the relationship between the temperature of adhesive at the surface 2*b* and the quantity of water in the body 24 of adhesive.

If the signals being transmitted by the unit 16 are of a nature which excludes leakage of adhesive from the vessel 8 but indicate that the quantity of adhesive in the adhesive bulge at the outlet opening 12 drops, the stage 25 transmits a signal via conductor 23 to start the pump 21 so that the outlet 22 discharges a requisite quantity of water onto the surface 2*b*, i.e., into the vessel 8. This restores the viscosity of the adhesive in the vessel 8 to a desired value, i.e., the viscosity of the adhesive is acceptable irrespective of the duration of idleness of the machine which processes the adhesive-coated substrate 26.

The exact details of the signal generating and processing means in the illustrated apparatus or its equivalents form no part of the present invention. Thus, the sensors 14, 17, the signal processing unit 16 and the signal comparing stage 25 can constitute commercially available (standard) components, as long as they can perform their aforediscussed functions.

An important advantage of the control system including the sensors 14, 17, the signal generating unit 16 and the signal comparing stage 25 is that the percentage of evaporable constituent in the adhesive can be maintained within a required or selected range regardless of whether or not the substrate 26 is running, i.e., regardless of whether or not the conduit 9 is required to replenish the supply of adhesive in the vessel 8.

Another advantage of the improved apparatus is that the percentage of evaporable constituent of the adhesive in the vessel 8 is not unduly increased, namely to a value which would cause excessive liquefaction of adhesive and prevent the substrate 26 from reliably bonding filter mouthpieces with plain cigarettes if the apparatus is embodied in a filter tipping machine.

Further advantages of the improved apparatus are its simplicity, compactness and reliability.

The improved method comprises the steps of monitoring the consistency of the adhesive and changing the percentage of the evaporable constituent when the monitoring step indicates the need for such change.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of applying adhesive to running substrates and, therefore, such adaptations should and are intended to be comprehended within the meaning and range of equivalence of the appended claims.

What is claimed is:

1. Apparatus for applying to a running substrate at least one film of an adhesive normally containing a preselected percentage of an evaporable constituent, comprising:

a vessel for a supply of adhesive;

means for supplying to the vessel a flow of adhesive;

a rotary applicator having a surface dipping into said supply to continuously draw a film of adhesive from the vessel, to apply the withdrawn film to the running substrate outside of the vessel, and to thereupon reenter the vessel and restore the film;

means for limiting the quantity of adhesive leaving the vessel with said surface;

signal generating means for monitoring the supply of adhesive in the vessel to ascertain the actual percentage of evaporable constituent;

a source of evaporable constituent; and means for admitting evaporable constituent from said source to the adhesive in response to signals denoting that the actual percentage of evaporable constituent is below said preselected percentage.

2. The apparatus of claim 1, wherein said applicator comprises a first roller and means for driving said first roller in a first direction, said means for limiting comprising a second roller and means for rotating said second roller in a second direction counter to said first direction, said rollers defining a nip for a portion of the supply of adhesive in said vessel and said supply having a bulge which is monitored by said signal generating means.

3. The apparatus of claim 1, wherein the evaporable constituent contains water.

4. The apparatus of claim 1, wherein said signal generating means comprises means for monitoring the quantity of adhesive in said vessel.

5. The apparatus of claim 4, wherein said vessel has at least one overflow opening for adhesive and said signal generating means comprises means for monitoring the quantity of adhesive overflowing through said at least one opening.

6. The apparatus of claim 5, wherein said means for supplying adhesive comprises at least one conduit arranged to supply a continuous flow of adhesive from a source of adhesive into said vessel.

7. The apparatus of claim 5, wherein said means for monitoring the quantity of adhesive overflowing through said at least one opening comprises at least one sensor disposed at a predetermined distance from said at least one opening.

8. The apparatus of claim 1, wherein said signal generating means comprises at least one sensor having means for monitoring the distance from the adhesive in said vessel.

9. The apparatus of claim 1, wherein said vessel has at least one overflow opening for adhesive and said admitting means comprises at least one outlet for evaporable constituent in the region of said at least one overflow opening.

10. The apparatus of claim 9, wherein said outlet is arranged to direct evaporable constituent against said limiting means.

11. The apparatus of claim 9, wherein said admitting means comprises a receptacle for evaporable constituent and a pump arranged to deliver evaporable constituent from said receptacle to said at least one outlet in response to said signals.

12. The apparatus of claim 11, wherein said at least one outlet is provided in a distributor adjacent said vessel.

13. The apparatus of claim 1, wherein said signal generating means includes means for monitoring the temperature of at least one of said applicator and said limiting means and means for generating first signals denoting the monitored temperature.

14. The apparatus of claim 13, wherein said signal generating means further comprises means for monitoring the quantity of adhesive in said vessel and for generating second signals denoting the monitored quantity of adhesive.

15. The apparatus of claim 14, wherein said signal generating means further comprises means for processing said first and second signals and means for transmitting processed signals to said source.

16. The apparatus of claim 15, wherein said processing means comprises means for transmitting processed signals denoting a relationship between the monitored temperature and changes of the percentage of evaporable constituent in the monitored quantity of adhesive.

* * * * *